US009752334B2

(12) United States Patent
Foley et al.

(10) Patent No.: US 9,752,334 B2
(45) Date of Patent: Sep. 5, 2017

(54) FOLDABLE WORK PLATFORM DEVICE

(71) Applicant: Tricam Industries, Inc., Eden Prairie, MN (US)

(72) Inventors: Joseph P. Foley, St. Paul, MN (US); Benjamin P. Williams, Chaska, MN (US); Dennis D. Simpson, Plymouth, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 0 days.

(21) Appl. No.: 15/262,185

(22) Filed: Sep. 12, 2016

(65) Prior Publication Data

US 2017/0044780 A1 Feb. 16, 2017

Related U.S. Application Data

(63) Continuation of application No. 29/536,154, filed on Aug. 13, 2015, now Pat. No. Des. 776,826.

(60) Provisional application No. 62/303,085, filed on Mar. 3, 2016.

(51) Int. Cl.

| | |
|---|---|
| ***E04G 1/34*** | (2006.01) |
| ***E04G 1/28*** | (2006.01) |
| ***B25H 1/04*** | (2006.01) |

(52) U.S. Cl.

CPC ..... *E04G 1/34* (2013.01); *B25H 1/04* (2013.01); *E04G 1/28* (2013.01)

(58) Field of Classification Search

CPC ..... E04G 1/28; E04G 1/34; E04G 2001/302; E04G 2001/305; E04G 2001/307

See application file for complete search history.

(56) References Cited

U.S. PATENT DOCUMENTS

| | | | | |
|---|---|---|---|---|
| 1,133,109 | A * | 3/1915 | Derbyshire | A47B 3/0912 108/132 |
| 2,587,177 | A | 2/1952 | Larson | |
| 5,096,019 | A * | 3/1992 | Kelsay | B25H 1/06 108/132 |
| 5,678,653 | A | 10/1997 | Clinch | |
| 5,746,288 | A * | 5/1998 | O'Neal | E04G 1/34 182/118 |
| D486,243 | S | 2/2004 | Yamaoka | |
| 6,892,860 | B2 * | 5/2005 | Gibson | E04G 1/28 108/119 |

(Continued)

OTHER PUBLICATIONS

Application and File History for U.S. Appl. No. 29/536,154, filed Aug. 13, 2015. Inventors: Joseph P. Foley et al.

(Continued)

*Primary Examiner* — Katherine Mitchell
*Assistant Examiner* — Marcus Menezes
(74) *Attorney, Agent, or Firm* — Patterson Thuente Pedersen, P.A.

(57) ABSTRACT

A foldable work platform is disclosed. The foldable work platform includes legs on the exterior of the platform for increased stability while allowing the legs to fold coplanar to the platform when the foldable work platform is in its stored configuration. The legs are also configured to fit within the profile of the platform and attached to the platform at a location which allows the legs to fit within the length of the platform. The legs include a support, on which the platform rests when the foldable work platform is in its in-use configuration.

14 Claims, 15 Drawing Sheets

(56) References Cited

U.S. PATENT DOCUMENTS

| | | | | |
|---|---|---|---|---|
| 7,516,704 | B2 * | 4/2009 | Snider | B25H 1/04 108/25 |
| 8,042,653 | B2 | 10/2011 | Grebinoski et al. | |
| 8,113,316 | B2 * | 2/2012 | Sward | G01N 33/497 108/62 |
| 8,307,769 | B1 * | 11/2012 | Wescott | A47B 3/0912 108/132 |
| 9,512,627 | B2 * | 12/2016 | Taron | B25H 1/04 |
| 2004/0238280 | A1 * | 12/2004 | Gibson | E04G 1/28 182/153 |
| 2006/0169539 | A1 * | 8/2006 | Grebinoski | E04G 1/15 182/223 |
| 2007/0101910 | A1 * | 5/2007 | Haimoff | A47B 3/0818 108/169 |
| 2009/0078165 | A1 * | 3/2009 | Tseng | A47B 3/0912 108/6 |
| 2010/0071996 | A1 * | 3/2010 | Huang | E04G 1/34 182/118 |

OTHER PUBLICATIONS

Harbor Freight, "Step Stool/Working Platform", http://www.harborfreight.com/step-stool-working-platform-66911.html, accessed Sep. 17, 2015, 1 page.

California Car Cover Co., "Folding Platform Ladder", http://www.calcarcover.com/product/1562/107/Folding_Platform_Ladder, accessed Sep. 17, 2015, 2 pages.

Bauer Corporation, "20900 Fold-N-Go Platform 500 lb. Capacity", http://www.bauerladder.com/safety-ladder/20900-fold-n-go-work-platform.html, accessed Sep. 17, 2015, 1 page.

http://www.canbuilt.com/images_thumb/WP-1238.jpf, accessed Sep. 17, 2015, 1 page.

http://sell.lulusoso.com/upload/20120309/Aluminum_work_platform.jpg, accessed Sep. 17, 2015, 1 page.

* cited by examiner

FOLDABLE WORK PLATFORM DEVICE

CROSS-REFERENCE TO RELATED APPLICATIONS

The present application claims the benefit of U.S. Design Application No. 29/536,154, filed Aug. 13, 2015, entitled "WORK PLATFORM," and U.S. Provisional Application No. 62/303,085, filed Mar. 3, 2016, entitled "FOLDABLE WORK PLATFORM," each of which is hereby fully incorporated herein by reference.

FIELD OF THE INVENTION

The present invention relates to portable platforms and, more particularly, to folding portable work platforms.

BACKGROUND OF THE INVENTION

Professional tradespersons such as painters, drywall installers, and electricians require an elevated surface upon which to stand to reach the location of their work. Homeowners, too, have the need for elevated platforms for various home improvement projects. Ladders and stepstools are inconvenient because they have a narrow width and require continued movement to work on an area of more than a couple feet in length. Therefore, many tradespersons and homeowners use a work platform to provide elevation with extended length.

Work platforms and scaffolds are well-known in the art. More recent improvements allow for increased portability, storage, and height and length adjustability. However, the improvements also result in disadvantages. For example, most of the improvements result in a less stable work platform as well as decreased load bearing. Another shortcoming of many of these improvements is complex mechanisms that allow for the folding and adjustability.

What is desired is a portable work platform that provides superior stability and load bearing while being highly storable and portable, yet easy to transform from a storage configuration to a use configuration.

SUMMARY OF THE INVENTION

The present invention is directed to an improved portable work platform with superior stability and load bearing while being highly storable and portable. The foldable work platform has legs on the exterior of the platform to provide increased stability while allowing the legs to fold parallel to the platform when in the stored configuration. Having the legs pivotally attached to the platform at locations away from the ends of the platform allows the platform to rest on a support mounted to the legs, which further increases the stability and load bearing of the portable work platform. Each pair of legs also includes a simplified locking mechanism that allows a user to unlock the legs from an in-use configuration to a stored configuration with the simple push of a knob.

The above summary is not intended to describe each illustrated embodiment or every implementation of the subject matter hereof. Rather, the embodiments are chosen and described so that others skilled in the art can appreciate and understand the principles and practices of the invention. The figures and the detailed description that follow more particularly exemplify various embodiments.

Advantages of the Invention

Very portable.
Maximizes storability.
Easier to climb.
Improved stability.
Superior load bearing.
Easily converts from stored configuration to in-use configuration.

BRIEF DESCRIPTION OF THE DRAWINGS

Subject matter hereof may be more completely understood in consideration of the following detailed description of various embodiments in connection with the accompanying figures, in which.

Figure 1:
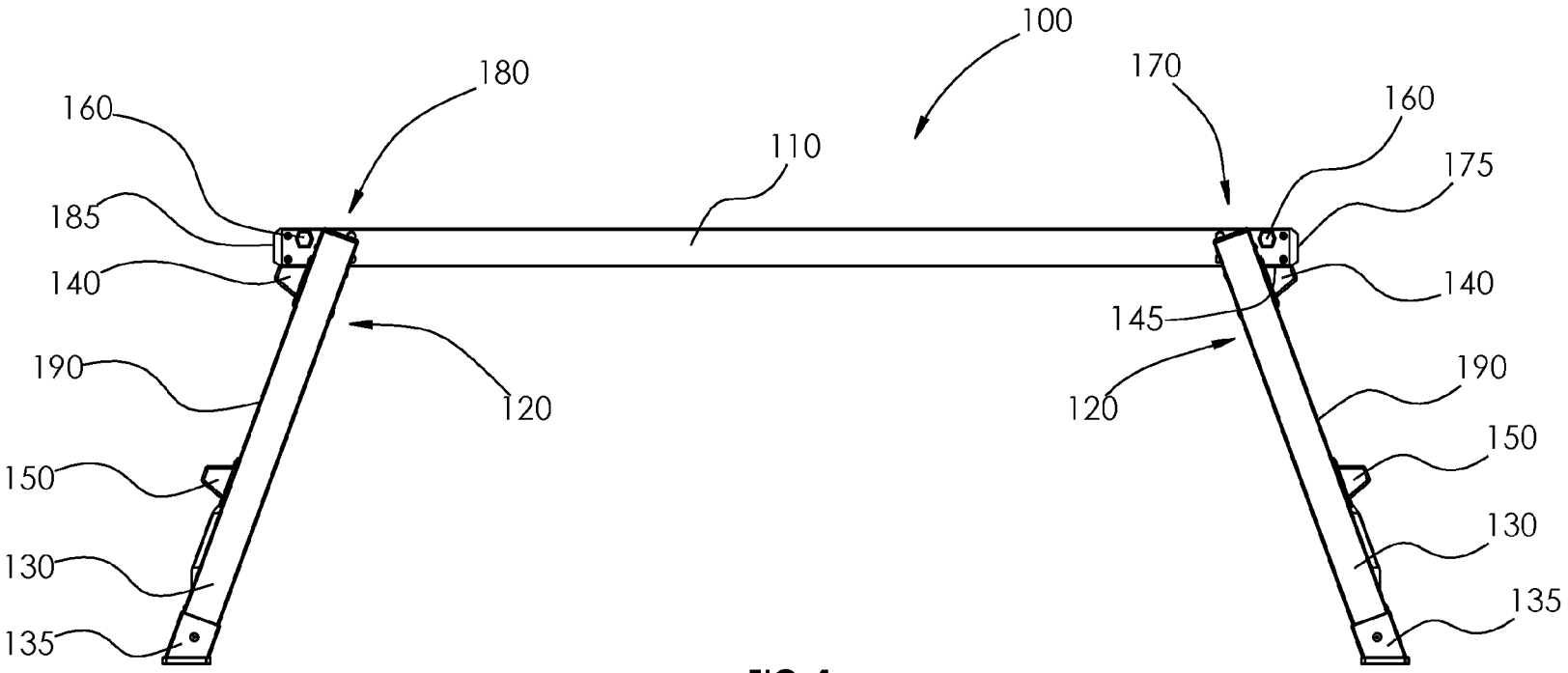
FIG. 1 is a front elevation view of a foldable work platform according to an embodiment of the invention in its in-use configuration.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

A foldable work platform according to an embodiment of the invention is depicted generally in FIG. 1 with reference numeral 100. The foldable work platform 100 includes a platform 110 and two leg frames 120, one leg frame 120 is mounted at a platform first end 170 and one leg frame 120 is mounted a platform second end 180. The leg frames 120 include a pair of legs 130 and support 140. In the preferred embodiment, the support spans between the legs 130. Rungs 150 may also span between the legs 130 to provide additional structural integrity to the foldable work platform 100 as well as provide steps for climbing onto the foldable work platform 100. The platform 100 can be a single piece or may be constructed of multiple planks attached lengthwise to form a single platform 100.

In a preferred embodiment of the invention, the leg frames 120 are pivotally mounted to the platform 110 at a distance from the platform first edge 175 and platform second edge 185. The preferred embodiment further includes a locking mechanism 160 for locking the leg frames 120 when the foldable work platform 100 is in the in-use configuration. The preferred embodiment also contemplates the platform 110, legs 130, support 140, and rungs 150 as extruded aluminum, with the support 140 and rungs 150 mounted to the outer face 190 of the legs 130. Each leg 130 may include a leg foot 135, preferably made of plastic, to provide both better footing for the foldable work platform 100 as well as electrical insulation from the ground surface. While materials of construction indicated are for the preferred embodiment, equivalent materials known in the art such as fiberglass, plastic, or steel may be used.

Figure 2:
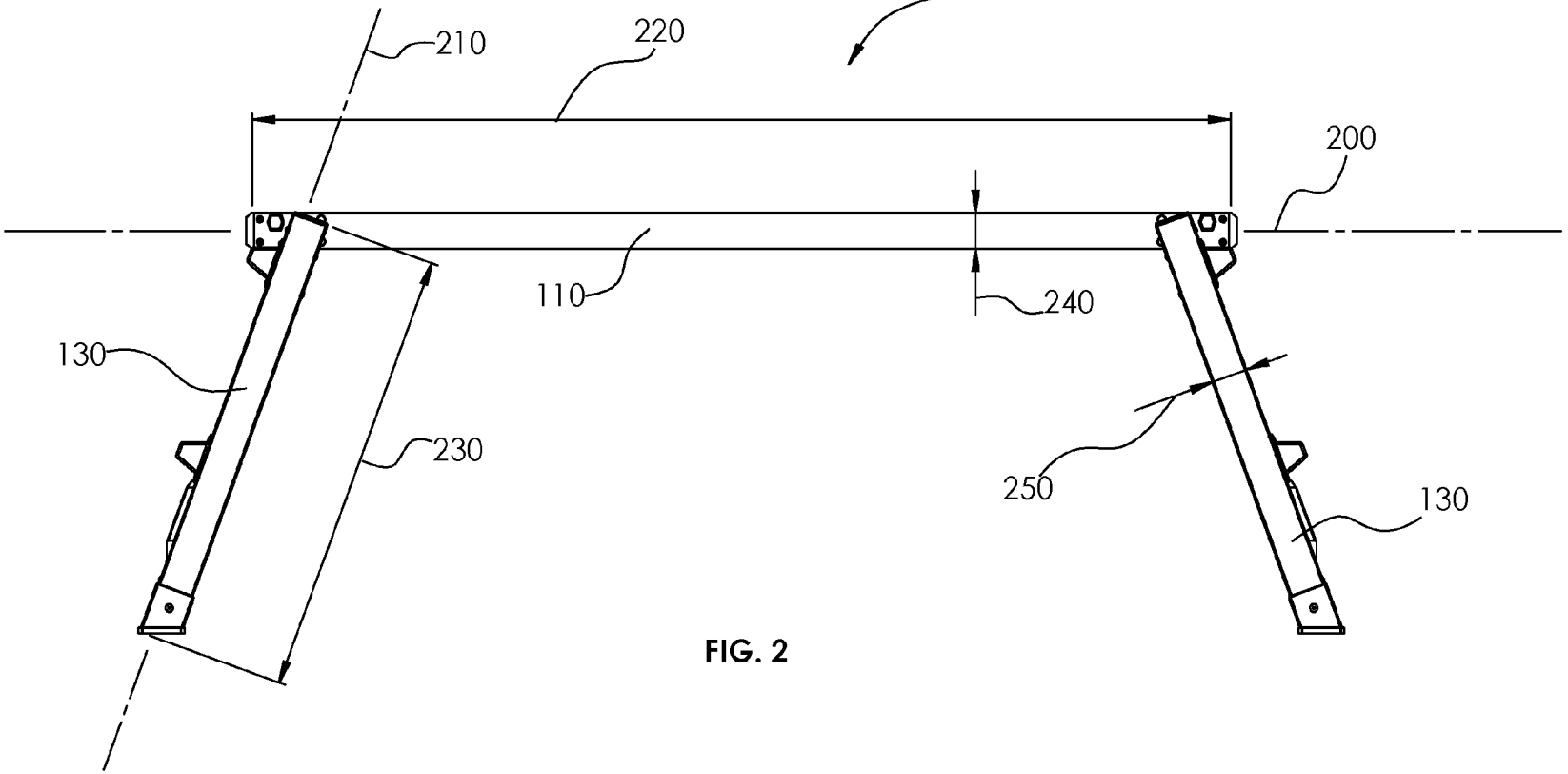
FIG. 2 is a rear elevation view of a foldable work platform according to an embodiment of the invention in its in-use configuration.
Figure 9:
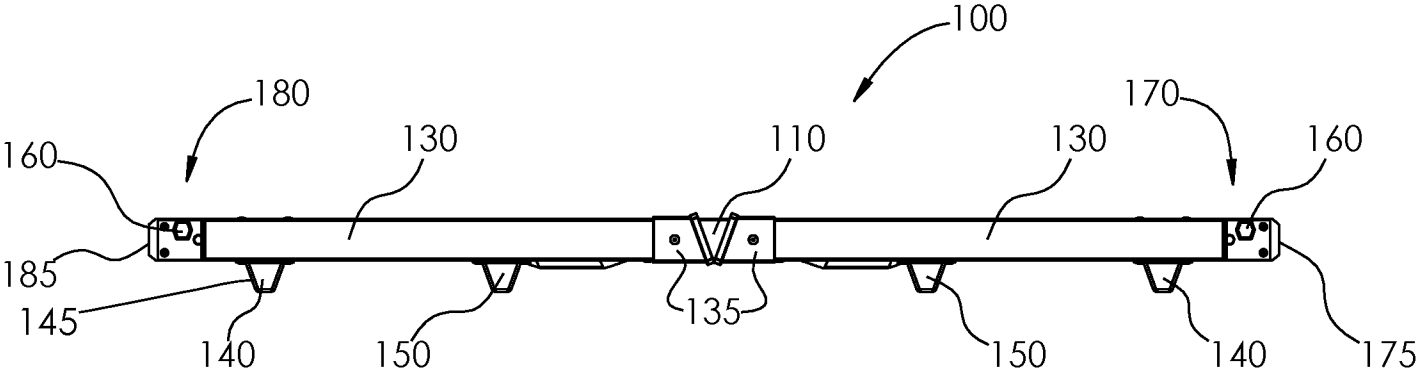
FIG. 9 is a front elevation view of a foldable work platform according to an embodiment of the invention in its stored configuration.
Figure 10:
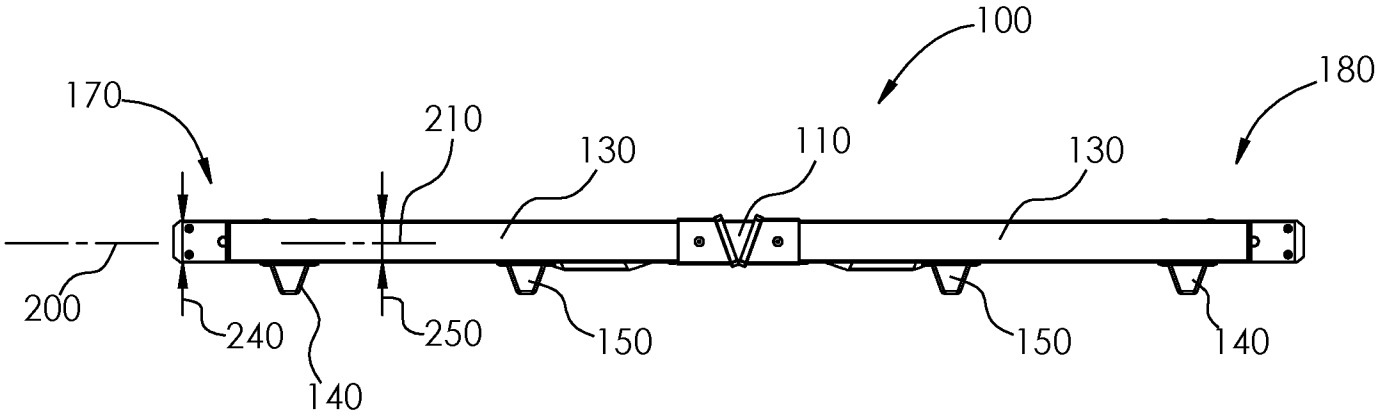
FIG. 10 is a rear elevation view of a foldable work platform according to an embodiment of the invention in its stored configuration
Figure 11:
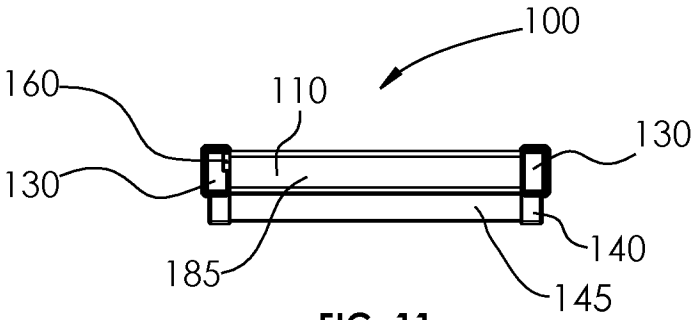
FIG. 11 is a right side elevation view of a foldable work platform according to an embodiment of the invention in its stored configuration.
Figure 12:
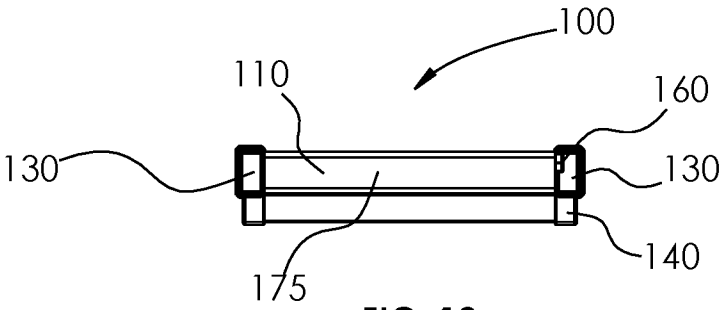
FIG. 12 is a left side elevation view of a foldable work platform according to an embodiment of the invention in its stored configuration.

FIG. 2 presents the same embodiment of FIG. 1 from the rear side of the foldable work platform 100. The platform 110 has a platform length 220, a platform height, 240, and a platform longitudinal axis 200. Each leg 130 has a leg length 230, a leg height 250, and a leg longitudinal plane 210. In the preferred embodiment of the foldable work platform 100, the leg height 250 is no greater than the platform height 240. This allows the legs 130 to be folded into the same front profile of the platform 110. FIGS. 9-10 more clearly show this aspect of the invention. As shown in FIG. 10, this preferred embodiment also contemplates each leg longitudinal plane 200 to be coplanar to the platform longitudinal plane 200 when the foldable work platform 100 is in the stored configuration. This aspect of the invention, in combination with the narrower leg height 250 than the platform height 240, maximizes the storability of the foldable work platform 100 without compromising strength and stability.

Figure 3:
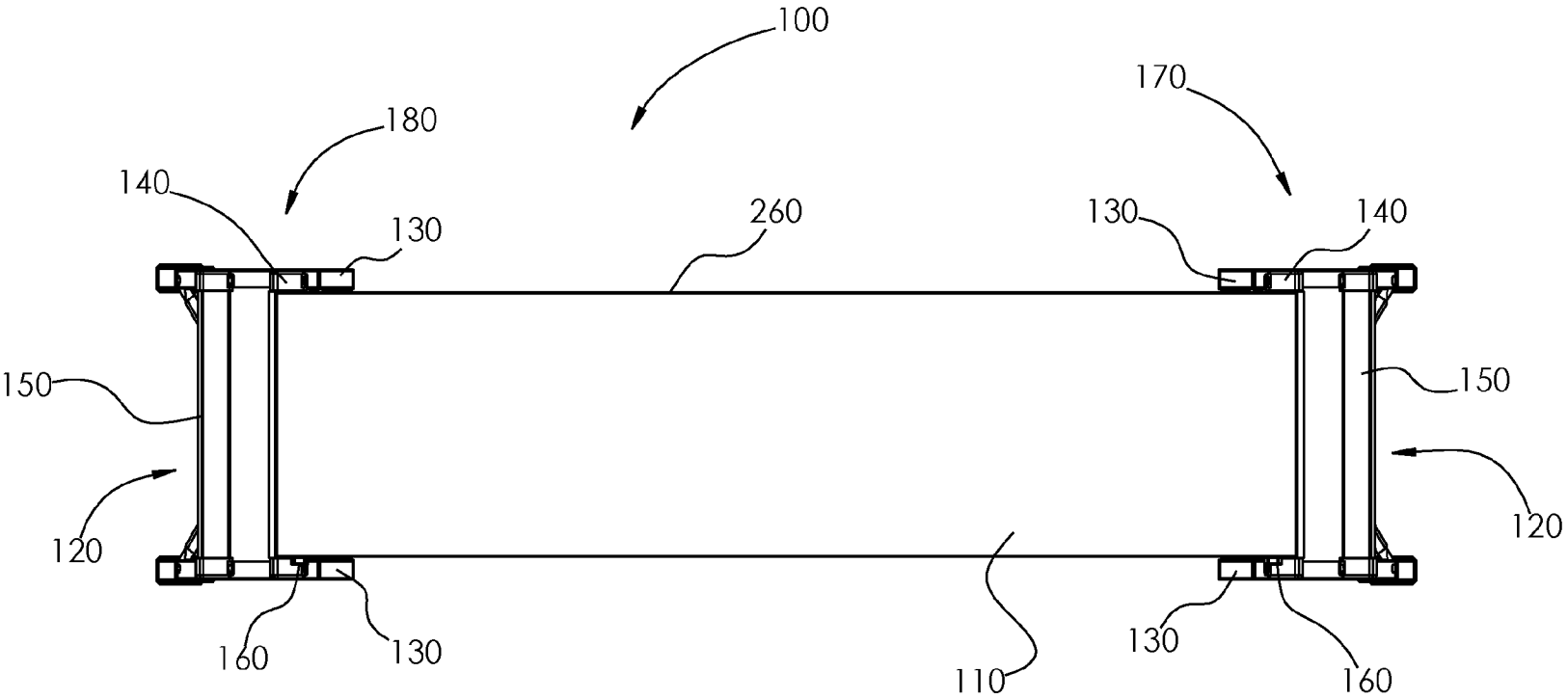
FIG. 3 is a top view of a foldable work platform according to an embodiment of the invention in its in-use configuration.
Figure 4:
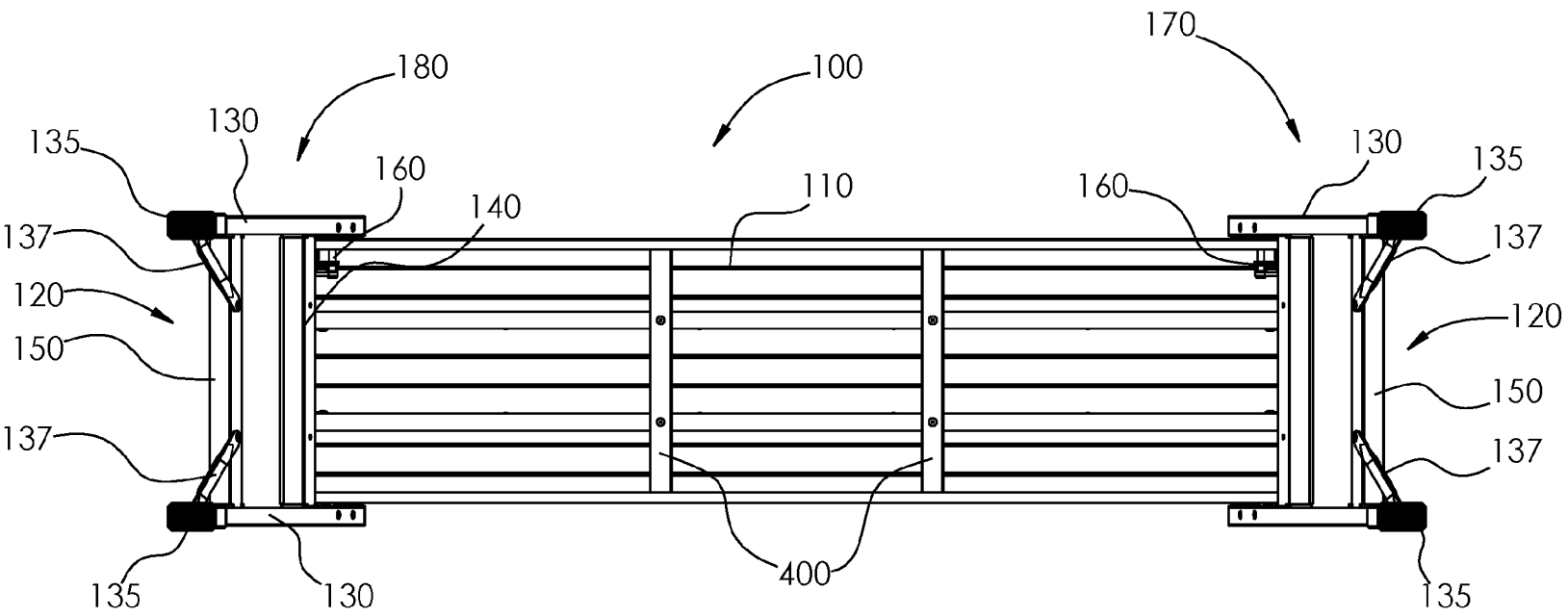
FIG. 4 is a bottom view of a foldable work platform according to an embodiment of the invention in its in-use configuration.
Figure 8:
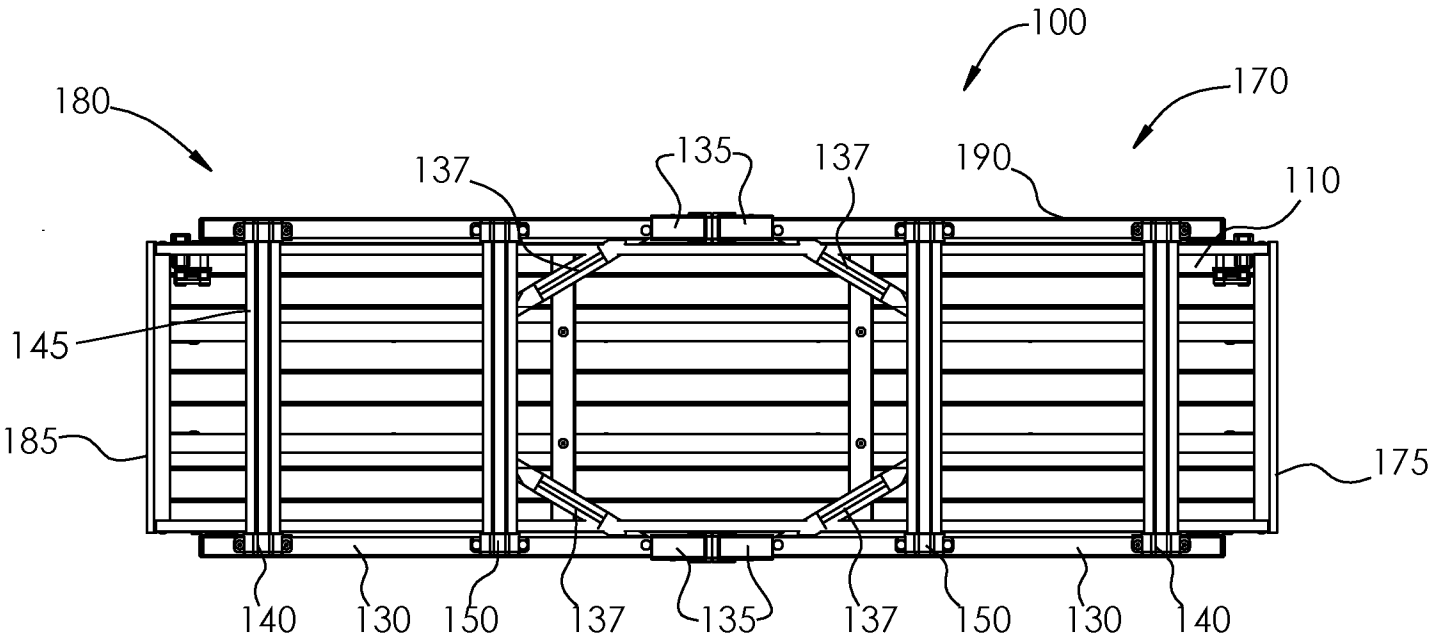
FIG. 8 is a bottom view of a foldable work platform according to an embodiment of the invention in its stored configuration.

The preferred embodiment of the invention also includes legs 130 that are mounted outside the platform outer perimeter 260. This feature, best seen in FIG. 3, in combination with the rungs 150 being mounted on the outer face 190 of the legs 130, provides easier access to place feet while climbing the foldable work platform 100. This feature also allows the use of platform braces 137 (see FIGS. 4 and 8) on the underside of the platform 110 without interference with the folding of the legs 130 when the foldable work platform 100 is in the stored configuration. FIG. 4 also shows the use of leg braces 137 that can be used to provide additional support, stiffness, and stability to the leg frames 120. The preferred location of the locking mechanisms 160 on the platform 110 is also shown in FIG. 4.

Figure 5:
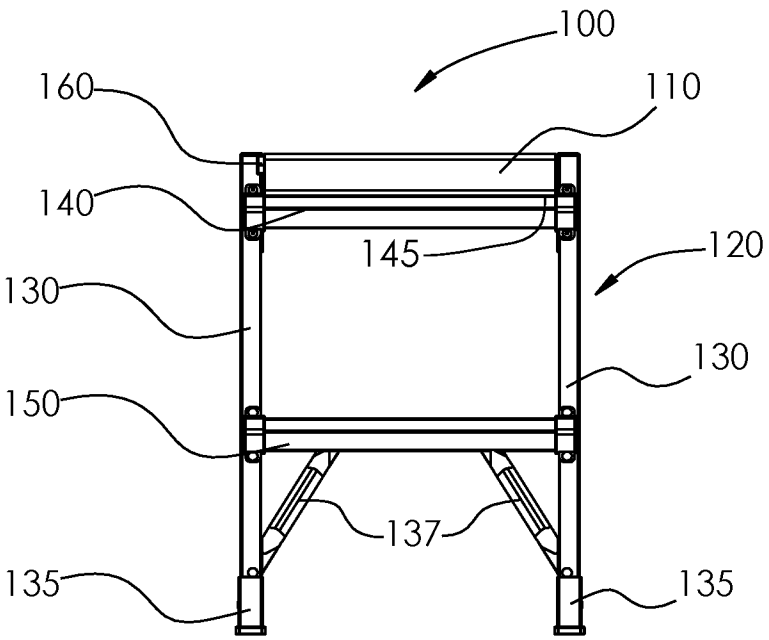
FIG. 5 is a right side elevation view of a foldable work platform according to an embodiment of the invention in its in-use configuration.
Figure 6:
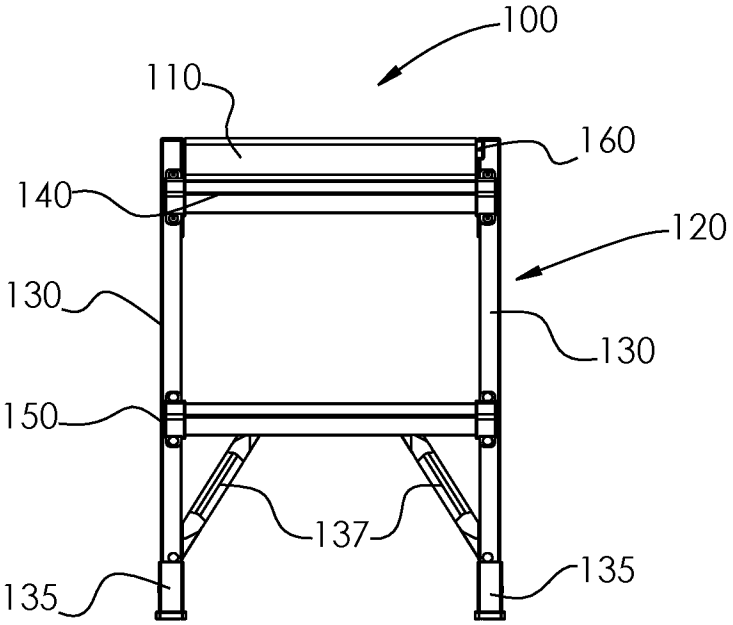
FIG. 6 is a left side elevation view of a foldable work platform according to an embodiment of the invention in its in-use configuration.

An important aspect of the preferred embodiment is the location of the leg support 140 of each leg frame 120 with respect to the platform 110 when the foldable work platform 100 is in the in-use configuration. More specifically, FIGS. 1, 2, and 5 show the platform 110 resting on a longitudinal face 145 of the leg support 140.As best seen in FIGS. 1-2 and 5-6, the platform 110 rests directly on the leg support 140 when in the in-use configuration. FIGS. 1, 5, 8-9, and 11 show the platform 110 resting on a longitudinal face 145 of the leg support 140. This arrangement provides superior strength and stability to the platform 110 by allowing the width of the platform 110 to be completely supported by the width of the support 140. FIGS. 5-6 also show a preferred placement of leg braces 137 used with rungs 150 for additional stability of the foldable work platform 100. While not shown, additional support may be added by using leg braces 137 with supports 140, but at the cost of adding weight to the foldable work platform 100.

Figure 7:
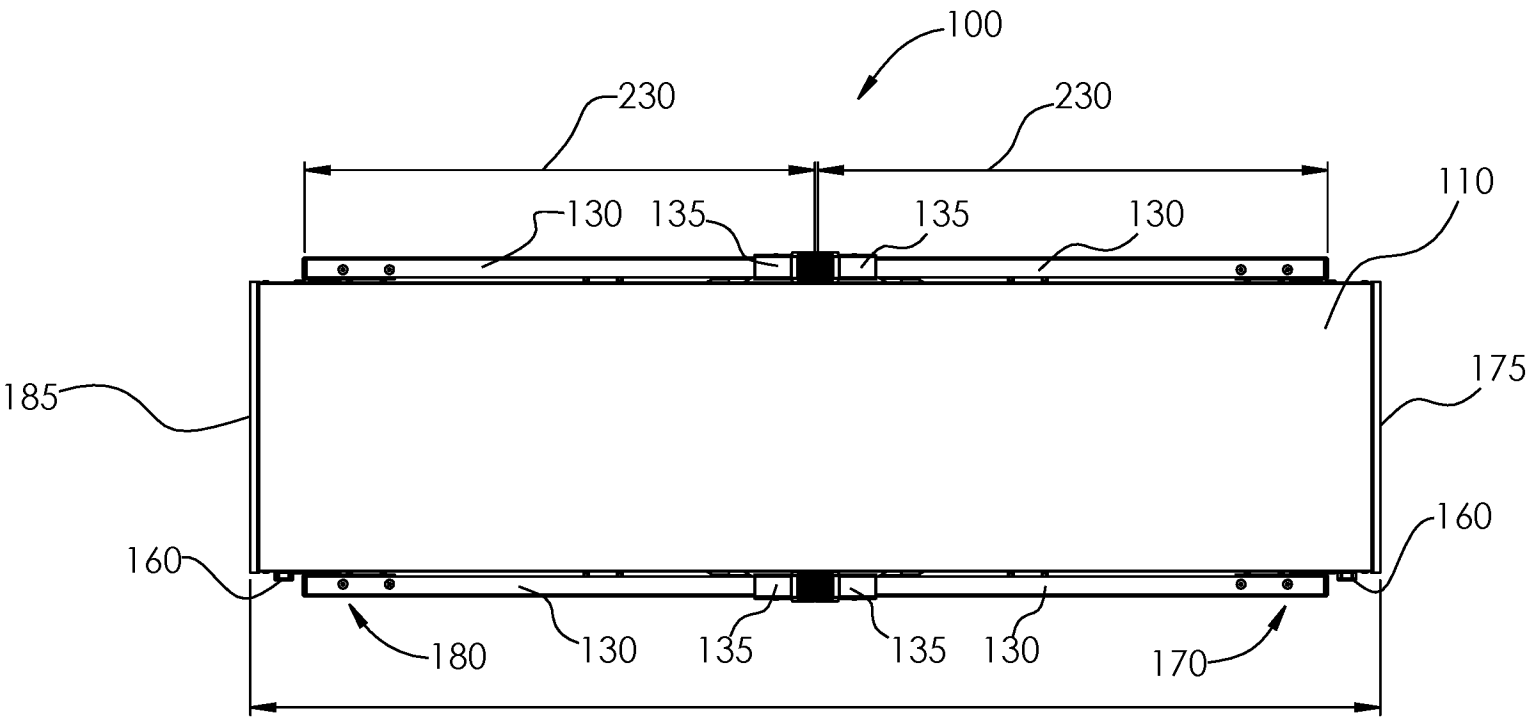
FIG. 7 is a top view of a foldable work platform according to an embodiment of the invention in its stored configuration.
Figure 13:
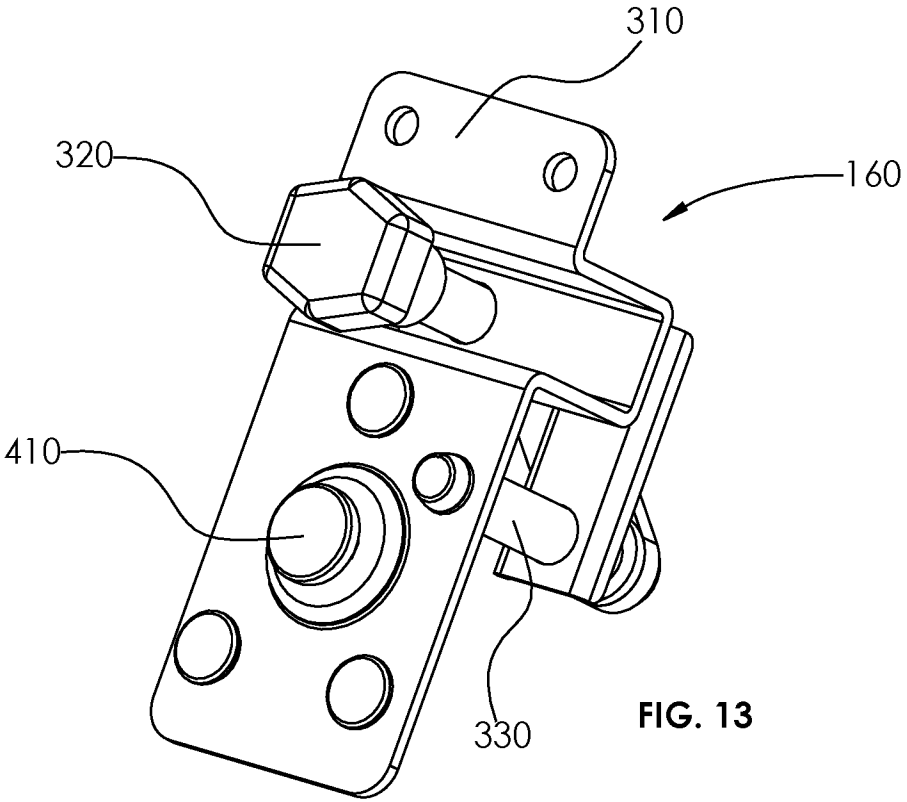
FIG. 13 is a front perspective view of an embodiment of the locking mechanism and pivot rivet for a foldable work platform.

FIG. 7 also illustrates the significance of the leg length 230 in relation to the platform length 220 in addition to the location of the pivotal attachment of the leg frames 120 to the platform 110. As best seen in FIG. 13, the legs 130 of a preferred embodiment are pivotally attached to the platform via pivot rivets 410. This arrangement minimizes the amount of material necessary for the attachments and, therefore, increases the portability by decreasing the weight of the foldable work platform 100. Other means of pivotal attachment known in the art, such as an axle that runs the width of the platform 110, are also contemplated.

FIGS. 7-12 show a preferred embodiment of the foldable work platform 100 in its stored configuration. Again, in this configuration the legs 130 are folded to fit within the profile of the platform 110 (i.e., leg height 250 is no greater than platform height 240). Additionally, these figures illustrate that the leg longitudinal plane 210 of all legs 130 are coplanar to the platform longitudinal plane 200.

Figure 14:
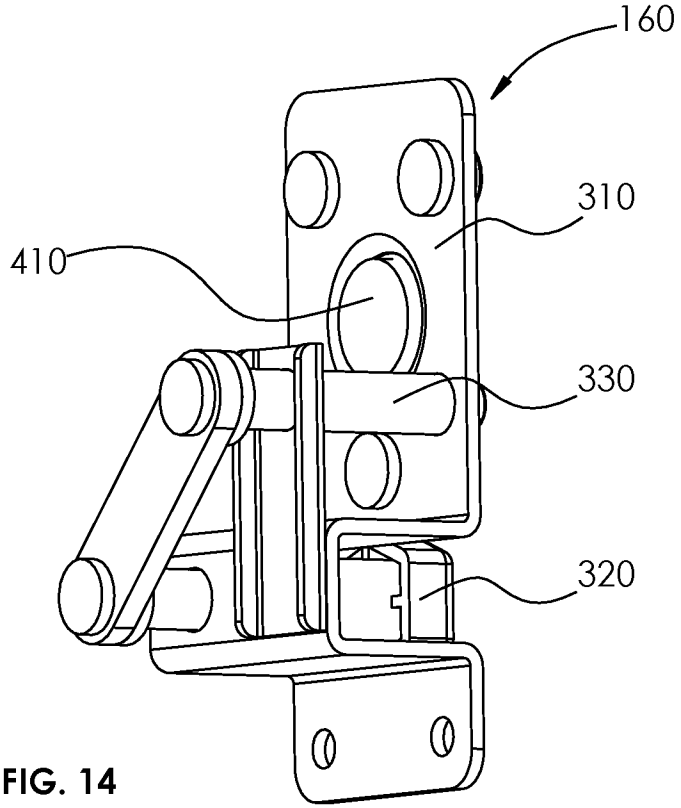
FIG. 14 is a rear perspective view of an embodiment of the locking mechanism and pivot rivet for a foldable work platform.
Figure 15:
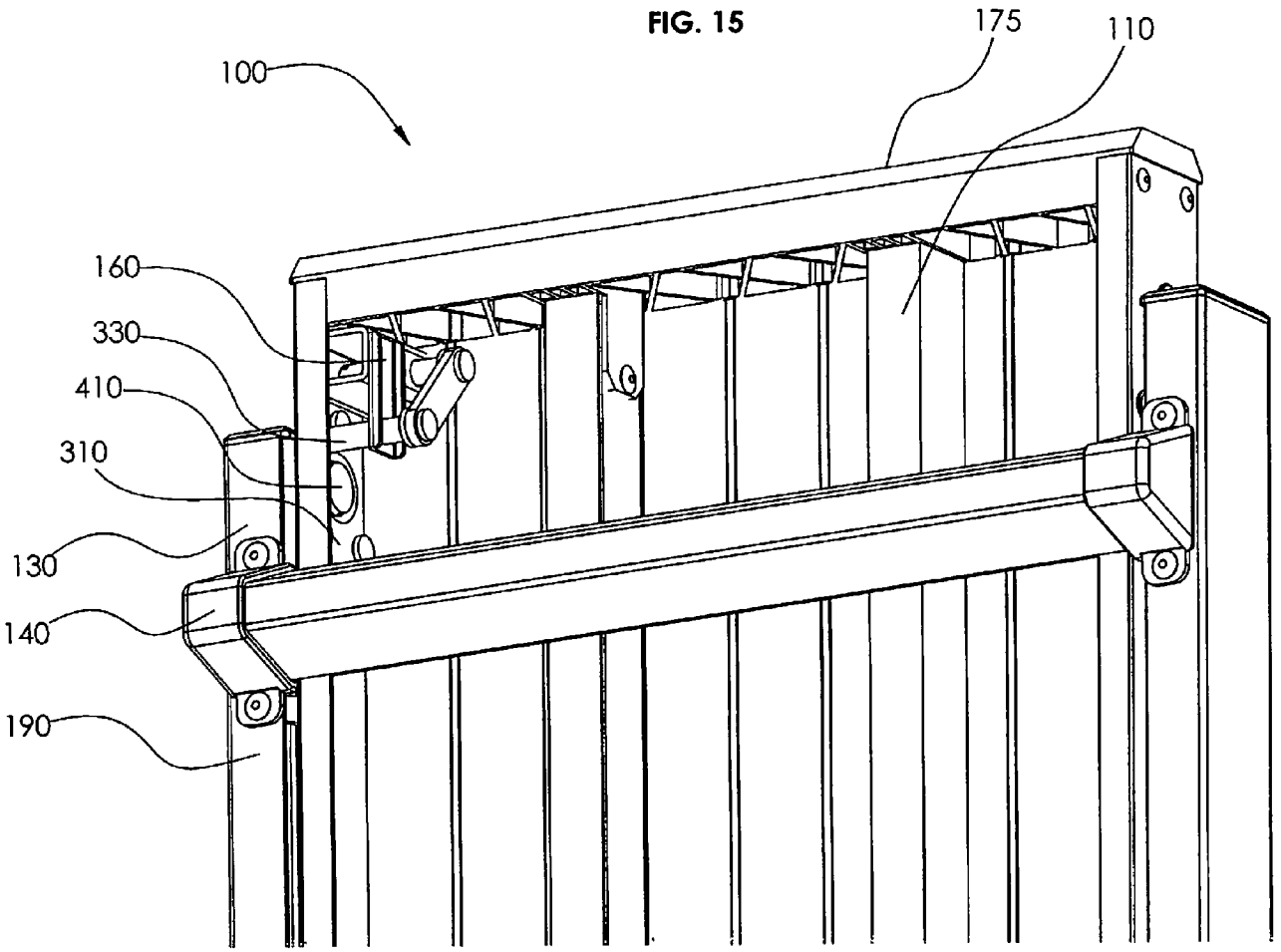
FIG. 15 is perspective view bottom view of the right portion of an embodiment of the invention in its stored position.

FIGS. 13-15 provide close-up illustrations of the locking mechanism 160 and pivot rivets 410 of an embodiment of the invention. The locking mechanism 160 includes a locking/pivoting mechanism body 310 that is attached to the underside of the platform 110. The locking/pivoting mechanism body 310 can be mounted to the platform 110 by any means known in the art, such as riveting or welding. The pivot rivet 410 attaches leg 130 to platform 110. In the embodiment illustrated, the locking mechanism knob 320 is pressed when a user wishes to adjust the foldable work platform 100 from the in-use configuration to the stored configuration. Pressing the locking mechanism knob 320 slides the locking mechanism pin 330 out of a receiving orifice in the leg, which then allows the leg frame 120 to pivot to stored configuration. It is contemplated that a locking mechanism 160 may be provided for each leg 130, however, the preferred embodiment contemplates a single locking mechanism per leg frame 120 to minimize the overall weight of the foldable work platform 100.

The foldable work platform 100 of the present invention may not only be used as device to stand upon for elevation purposes. It is also contemplated that the foldable work platform may be used as a work table onto which materials may be placed or clamped.

We claim:

1. A folding work platform device comprising:

a platform having a first end, a second end, a longitudinal plane, and an outer perimeter;

a leg frame pivotally attached to the platform first end and a leg frame pivotally attached to the platform second end, each leg frame configured to be adjustable between an open position and a stored position and comprising:

a pair of legs, each leg having a longitudinal plane and being mounted exterior to the platform outer perimeter;

a rung member connecting the pair of legs; and a support member comprising a longitudinal face;

wherein the platform is configured to rest on the support member longitudinal face of each leg frame when the leg frame is in the open position; and wherein the platform longitudinal plane is horizontally coplanar to each leg longitudinal plane when each leg frame is in the stored position, wherein each leg comprises a planar outer face and wherein the rung member and support member of each leg frame are directly mounted to the outer face of the legs of each leg frame.

2. The folding work platform device of claim 1 wherein the platform first end and platform second end each comprise a platform edge and each leg frame is pivotally attached to the platform distal to each platform end's respective platform edge.

3. The folding work platform device of claim 2 wherein each leg frame support member connects a pair of legs.

4. The folding work platform device of claim 3 further comprising a locking mechanism to secure each leg frame in the open position.

5. The folding work platform device of claim 1, wherein the platform has a platform height and each leg has a leg height, each leg height is configured to be positioned within a boundary defined by the platform height when each leg frame is in the stored position.

6. The folding work platform device of claim 5 wherein the platform has a length and each leg has a length, each leg length is configured to be positioned within a boundary defined by the platform length when each leg frame is in the stored position.

7. The folding work platform device of claim 6 further comprising a locking mechanism to secure each leg frame in the open position.

8. A folding work platform device comprising:

a platform comprising a first end and a second end, each end further comprising a platform edge;

two legs pivotably attached to the platform first end distal the first end platform edge wherein each leg comprises a planar outer face, the two legs connected by a support member directly mounted to the outer face of each leg;

two legs pivotably attached to the platform second end distal the second end platform edge wherein each leg of the two legs pivotably attached to the platform second end comprises a planar outer face, the two legs pivotably attached to the platform second end connected by a support member directly mounted to the outer face of each leg, each support member comprising a longitudinal face;

wherein the legs are configured to be adjustable between an open position and a stored position and wherein the platform is configured to rest upon each support member longitudinal face when each leg is in the open position; and wherein the platform has a longitudinal plane and each leg has a longitudinal plane and wherein the longitudinal plane of each leg is horizontally coplanar to the longitudinal plane of the platform when each leg is in the stored position.

9. The folding work platform device of claim 8, wherein the platform has a platform height and each leg has a leg height, each leg height is configured to be positioned within a boundary defined by the platform height when each leg is in the stored position.

10. The folding work platform device of claim 9 wherein each of the platform first end and platform second end further comprises a locking mechanism.

11. The folding work platform device of claim 10 wherein each locking mechanism engages a leg of the platform first end and a leg of the platform second end when the legs of the platform first end and of the platform second end are in the open position.

12. A folding work platform device comprising:

a platform having a longitudinal plane and two longitudinal ends wherein each platform end comprises a platform edge;

a leg frame pivotally attached to each of the platform longitudinal ends, each leg frame comprising a pair of legs each with a longitudinal plane, and a support member connecting the pair of legs;

wherein each leg frame is configured to be adjustable between an open position and a stored position;

wherein the platform is configured to rest upon the support member of each leg frame adjacent a platform edge when the leg frame is in the open position; and wherein the platform longitudinal plane is horizontally coplanar to each leg longitudinal plane when each leg frame is in the stored position, wherein each leg comprises a planar outer face and wherein the support member of each leg frame is directly mounted to the outer face of the legs of each leg frame.

13. The folding work platform device of claim 12 wherein the platform defines an outer perimeter and the legs are external of the platform outer perimeter.

14. The folding work platform device of claim 13 wherein each platform longitudinal end further comprises a locking mechanism.

* * * * *